United States Patent [19]

Okada et al.

[11] Patent Number: 4,841,216

[45] Date of Patent: Jun. 20, 1989

[54] ENGINE START TYPE VSCF GENERATING SYSTEM

[75] Inventors: Yoshimi Okada; Masao Kimura; Kazuo Okubo, all of Ise, Japan

[73] Assignee: Shinko Electric Co., Ltd., Tokyo, Japan

[21] Appl. No.: 196,518

[22] Filed: May 20, 1988

[30] Foreign Application Priority Data

Jul. 24, 1987 [JP] Japan ..... 62-183489

[51] Int. Cl.[4] ..... F02N 11/04; F02N 11/08

[52] U.S. Cl. ..... 322/10; 290/38 R; 290/46; 322/29

[58] Field of Search ..... 322/10, 11, 29; 290/38 R, 46

[56] References Cited

U.S. PATENT DOCUMENTS 4,330,743 5/1982 Glennon ..... 322/10
4,481,459 11/1984 Mehl et al. ..... 322/10
4,743,777 5/1988 Shilling et al. ..... 322/29 X

FOREIGN PATENT DOCUMENTS 8800653 1/1988 World Int. Prop. O. ..... 322/10

OTHER PUBLICATIONS

"*Brushless Generator for Aircraft*", A. W. Ford, Institute of Electrical Engineers, Paper No. 3812, 1962, pp. 437–442.

"*Brushless Excitation with Rotating Transformers*", Shinko Denki Technical Bulletin, vol. 16, No. 2, 1971, pp. 1–6.

*Primary Examiner*—R. J. Hickey

*Attorney, Agent, or Firm*—Armstrong, Nikaido, Marmelstein, Kubovcik & Murray

[57] ABSTRACT

An AC exciter and a main AC generator are mounted on a common rotating shaft of an engine, and a power rectifier and a power inverter are connected in series to the output of the main AC generator. In starter mode, an external AC power source is connected by a switch to the input of the power rectifier, and the output of the power inverter is applied to an armature winding of the main AC generator to drive it as a nocommutator motor to start the engine. A permanent magnet AC generator is also mounted on the common shaft of the engine to provide DC excitation to the AC exciter after converting the output of the permanent magnet AC generator into DC current, and the output of the permanent magnet AC generator is further utilized to detect the rotational speed of the engine to control the switch.

6 Claims, 8 Drawing Sheets

| FIG. 3A | FIG. 3B |
|---|---|

| FIG. | FIG. |
|---|---|
| 4A | 4B |

| FIG. 5A | FIG. 5B |
|---|---|

ENGINE START TYPE VSCF GENERATING SYSTEM

BACKGROUND OF THE INVENTION

1. Field of the Invention

The present invention relates to an engine start type VSCF generating system suitable for use as an electrical power generating system for airplanes.

2. Description of the Prior Art

Recently, with the progress in the practical use of a socalled VSCF (variable speed constant frequency) generating system which uses engine power as a driving source, the need for using a brushless generator as a brushless motor has been increased.

In a prior art VSCF generating system of the engine start type, it is usual to include separately a starter for starting the engine, and as shown in FIG. 1, such a system includes a starter 6 such as an air turbine or the like, for starting an engine 1, and an AC generator 2 is coupled to the engine 1. The AC output from the AC generator 2 is converted to desired AC power, for example, of three-phase, 115 V at 400 Hz through a power rectifier 3, a power inverter 4, and a filter 5.

Furthermore, a generating system of the DC excitation type is known, for example, from "Brushless Generator for Aircraft" by A. W. Ford, the Institute of Electrical Engineers Paper No. 3812 U, 1962, in which, as shown in FIG. 2A, this system includes a main generator 2 having a field winding 2*a* and an armature winding 2*b*, an AC exciter 9 having a field winding 9*a* and a rotor winding 9*b*, a DC power source 71, a DC controller 81, and a rotary rectifier 10. A rotor assembly K1 includes the rotor winding 9*b*, rotary rectifier 10, and field winding 2*a*.

In addition, a generating system of the AC excitation type is known, for example, from "Brushless Excitation with Rotating Transformer", SHINKO DENKI Technical Bulletin, Vol. 16, No. 2, 1971, in which as shown in FIG. 2B, and AC power source 72, an AC controller 82, and a rotary transformer 11 are provided to excite a field winding 2*a* of a main generator 2 by AC power through the rotary transformer 11 and a rotary rectifier 10. In this case, a rotor assembly K2 includes a secondary winding of the rotary transformer 11, the rotary rectifier 10, and the field winding 2*b*.

Specifically, the AC power supplied from the AC power source 72 is regulated by the AC controller 82 to an appropriate AC voltage according to a required torque at the time of starting, and the AC voltage is applied to the rotary transformer 11, the output thereof being rectified by the rotary rectifier 10 to excite the field winding 2*a*. In generation mode, AC power generated by a magnet generator (not shown) is regulated by the AC controller 82 so that an AC voltage which enables the main generator 2 to generate a constant voltage is applied to a primary winding of the rotary transformer 11.

However, the following problems are involved in the prior art systems.

In the system shown in FIG. 1 in which the starter 6 constituted by an air turbine or the like is separately provided, it is necessary to provide such an additional device (starter) as compared to the system used in airplanes wherein the DC power is primary electrical power and a generator for supplying power to various facilities in the airplane is used also as a DC motor serving as a starter for starting the engine. The necessity of such an additional device in particular poses a serious problem when the generating system is to be used on airplanes in which the reduction of weight is required.

In the DC excitation system shown in FIG. 2A, there has been the problem in that when the rotational speed of the rotor assembly K1 is zero, the electrical power is not generated in the exciter rotor winding 9*b* and therefore magnetic flux is not generated in the field winding 2*a* of the main generator 2.

On the other hand, in the AC excitation type system shown in FIG. 2B, since the rotary transformer 11 has no power amplifying capability, the stator and rotor require substantially equal capacity. As a result, although the field magnetic flux can be obtained at the time of starting, it is necessary to supply large electrical power to the rotary transformer 11 as compared to the exciter. Therefore the drawback is involved in that the size and weight is large as compared to the DC excitation type system.

SUMMARY OF THE INVENTION

It is an object of the invention to provide a VSCF generating system of the engine start type which requires no separate starter, which is compact and light in weight as compared with the prior art generating systems of the AC excitation type, and which is capable of generating field magnetic flux at the time of starting.

In order to achieve the above object, a VSCF generating system of the engine start type in the present invention comprises a main generator coupled to an engine, an AC exciter coupled to the engine for exciting the main generator, a power rectifier and a power inverter for converting output power of the main generator, a position sensor for detecting a position of a rotor of the main generator, and a distributor responsive to a signal of the position sensor for phase controlling the power inverter, wherein at the time of starting the engine, the main generator is operated as a no-commutator motor by using the position sensor and the distributor to obtain a starting torque, and a field winding (stator winding) of the AC exciter is selectively connected to an AC power source or a DC power source by a switch.

DESCRIPTION OF THE PREFERRED EMBODIMENT

Figure 1:
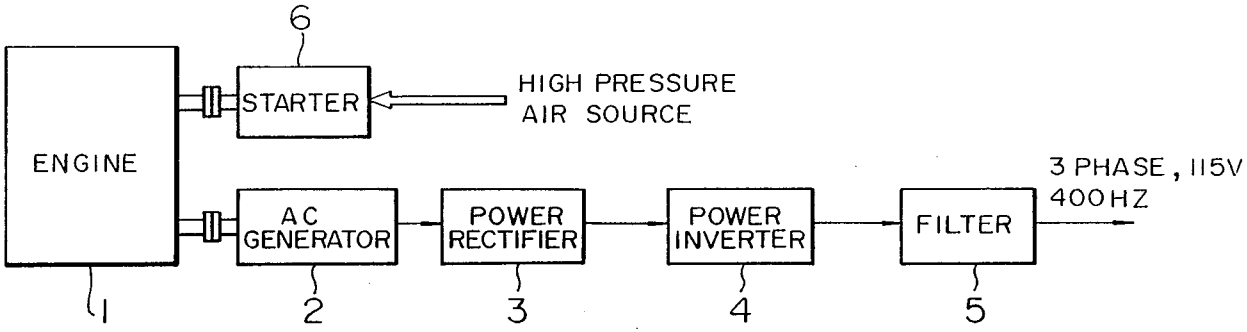
FIG. 1 PRIOR ART
FIG. 1 is a block diagram of a prior art VSCF generating system.
Figure 2A:
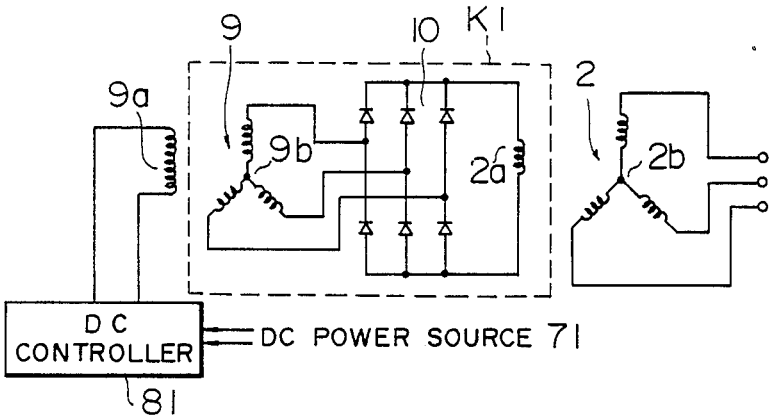
FIG. 2A PRIOR ART
FIGS. 2A and 2B are respectively circuit diagrams of prior art DC excitation type and AC excitation type generating systems.

With reference to FIGS. 3A to 5B, the present invention will be described by way of an embodiment of the invention. In the Figures, like reference numerals designate like or corresponding parts to those in FIGS. 1 and 2.

Figures 3A, 3C:
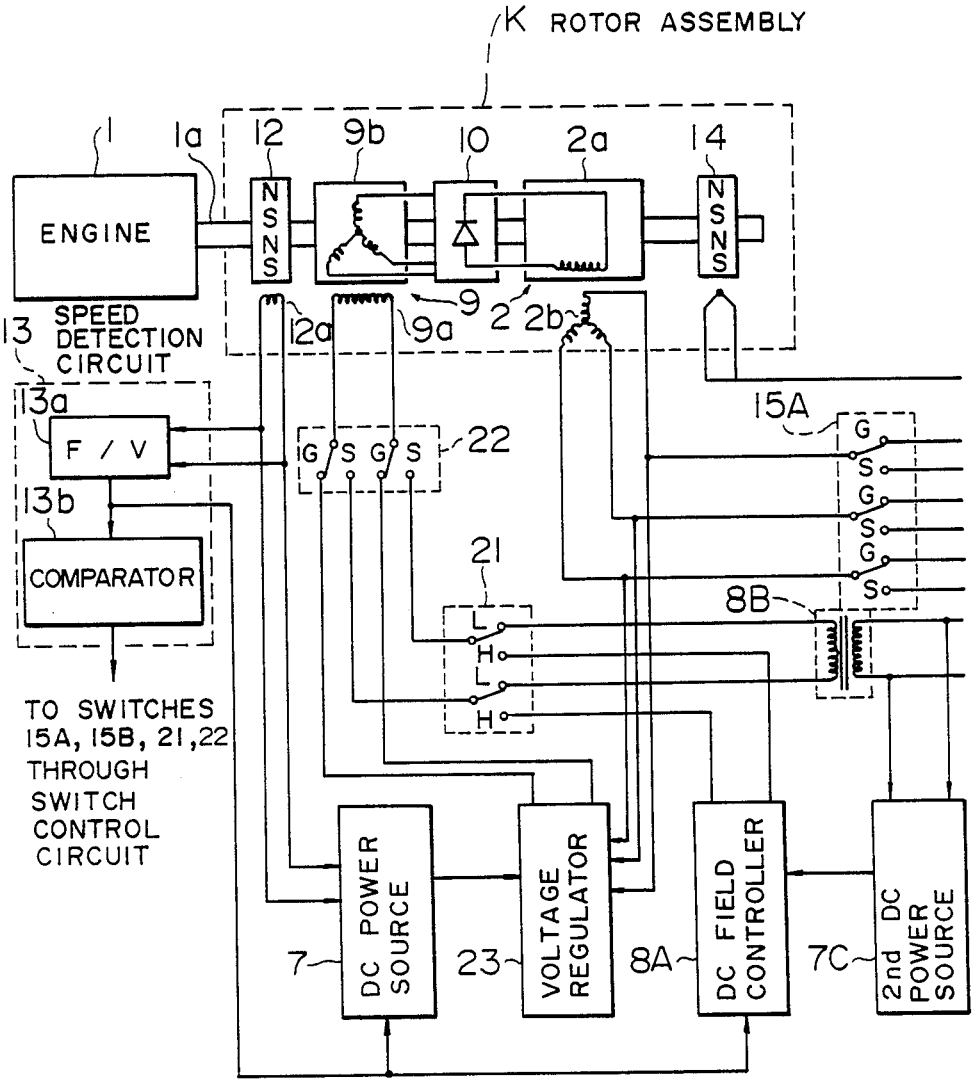
FIGS. 3A and 3B, connected as shown in FIG. 3C, comprise a block diagram of a VSCF generating system of an embodiment of the present invention.
Figure 3B:
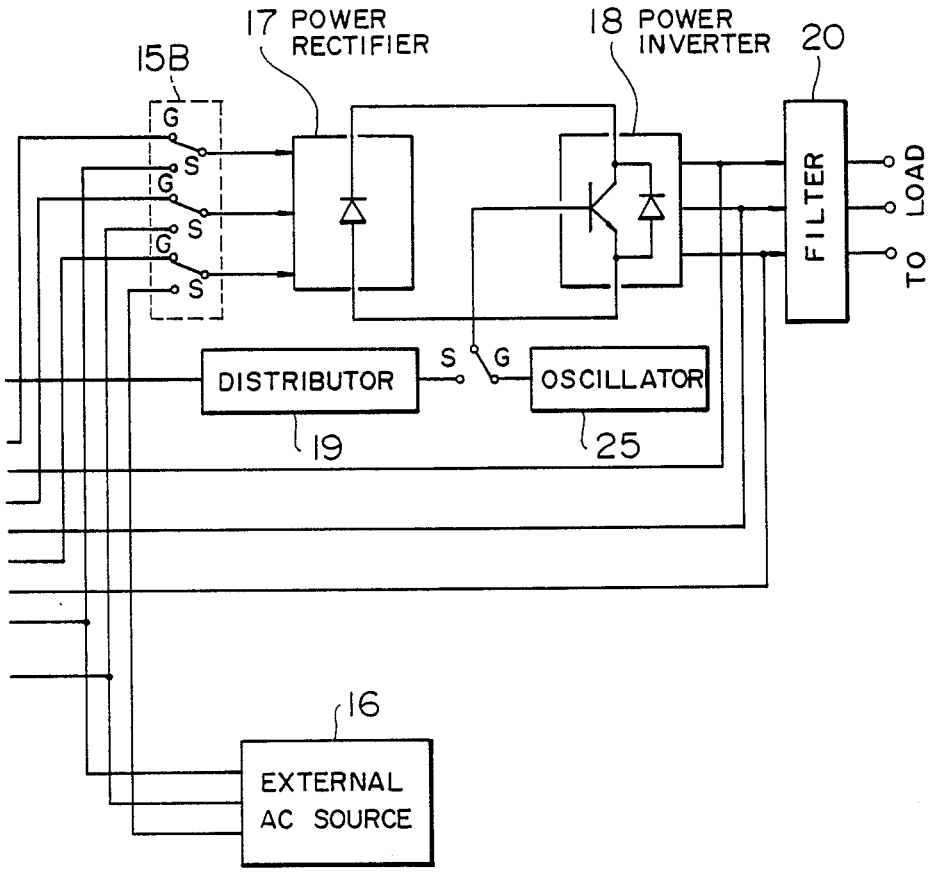

In FIG. 3A and 3B a permanent magnet generator 12 is mounted to a rotating shaft 1*a* of an engine 1, and it functions as an excitation power source for a field winding 9*a* of an AC exciter 9. AC output power from an output winding 12*a* of the permanent magnet generator 12 is converted by devices described later, and supplied to the field winding 9*a* for excitation by DC. The output of the permanent magnet generator 12 is also used to detect the rotational speed of the rotating shaft 1*a* of the engine 1, and for this purpose, the output is supplied to a speed detection circuit 13 having a frequency/voltage converter 13*a* and a comparator circuit 13*b*. The comparator circuit 13*b* includes, as shown in FIG. 5A and 5B differential amplifiers M11~M13, transistors Tr4 and Tr5, resistors R27~R30, and a Zener diode TZ3.

Figures 4A, 4C:
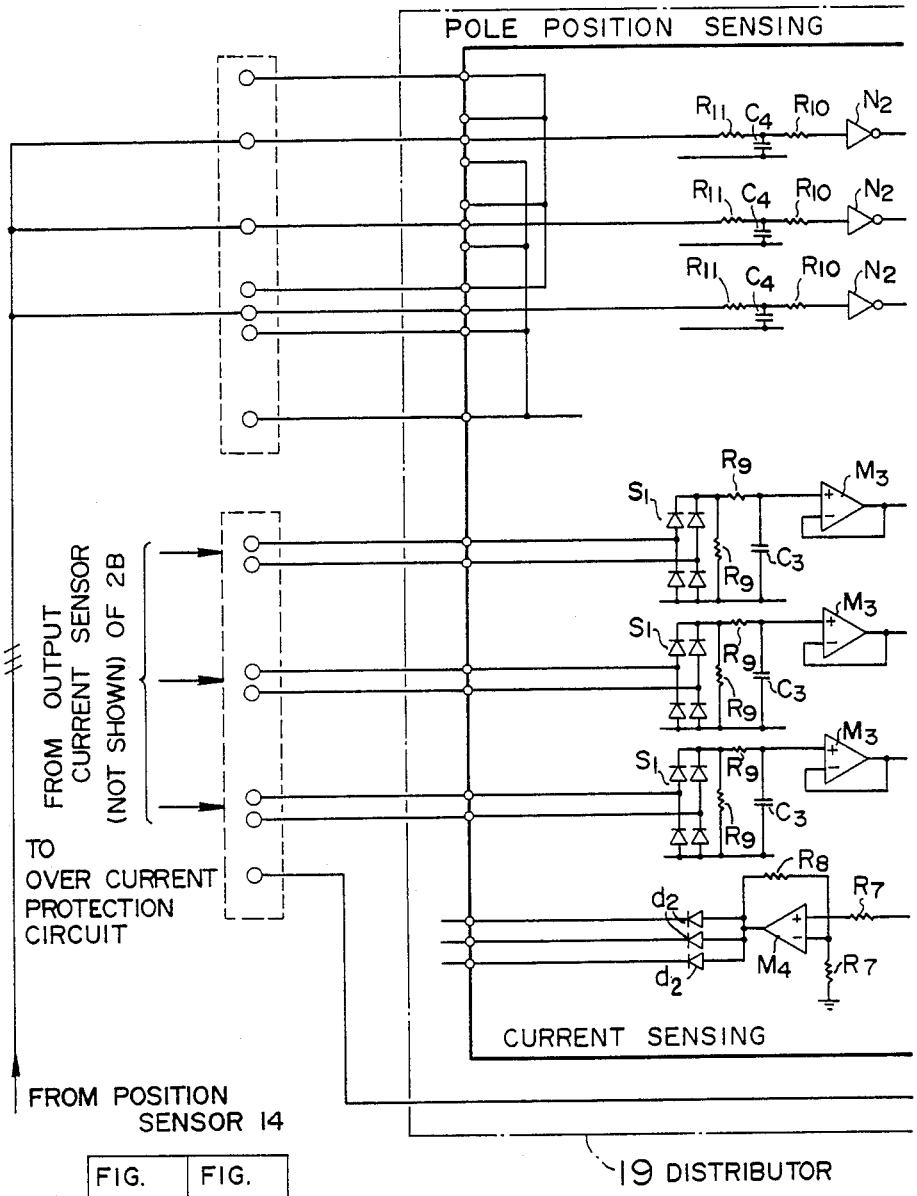
FIGS. 4A and 4B, connected as shown in FIG. 4C, comprise a circuit diagram of the distributor in FIG. 3.
Figure 4B:
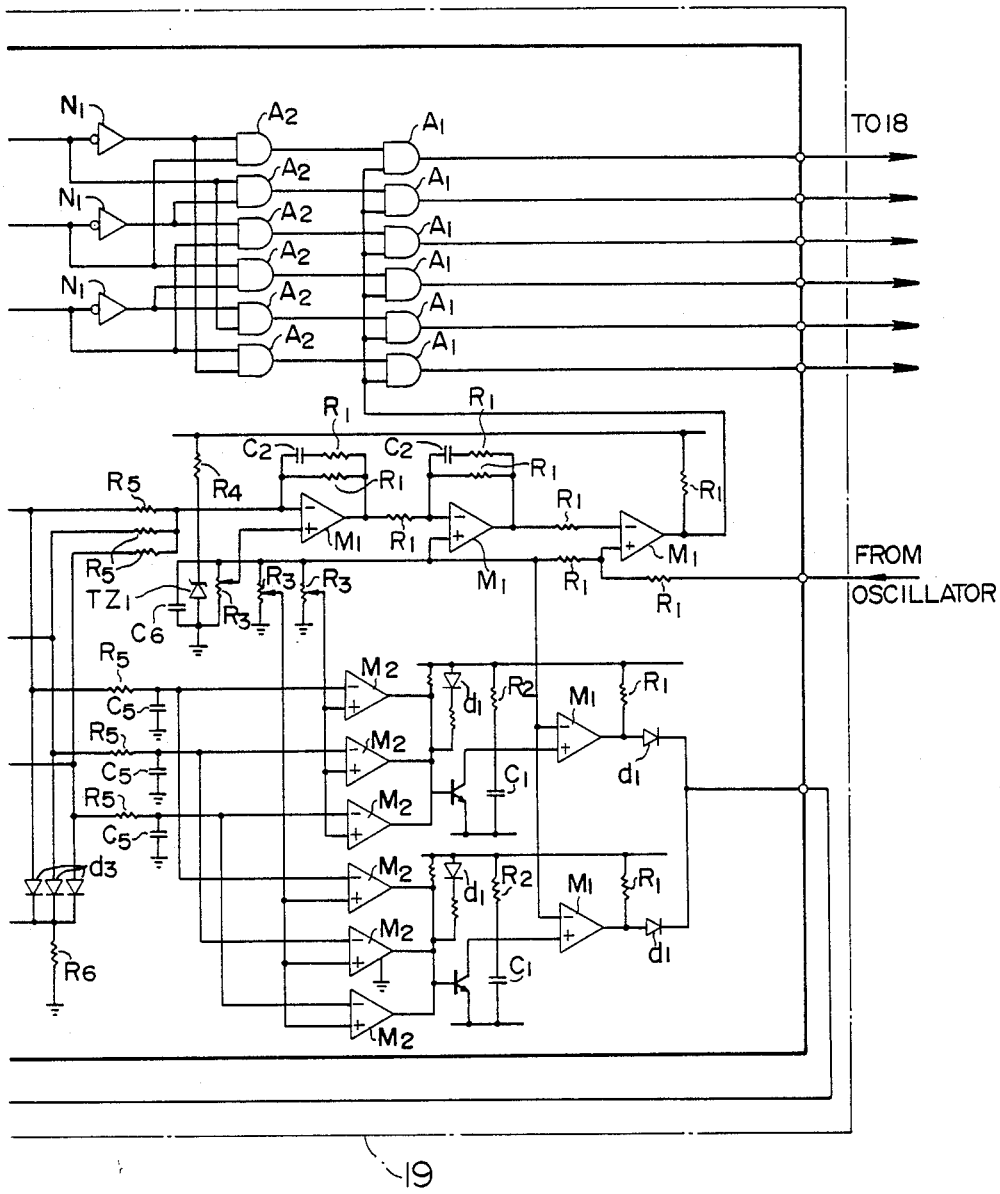

A position sensor 14 is mounted to the rotating shaft 1*a* to detect a rotational position of the rotating shaft 1*a*, and it provides a control signal for commutation to a distributor 19 which will be described later. A first switch 15A performs switching of the supply of an output of a power inverter 18 (described later) between an armature winding 2*b* of a main generator 2 and a load depending on whether the system is in starter mode (including low speed running) or normal running (generator) mode. On the other hand, a second switch 15B operates to switch sources of power supply to a power rectifier 17 between an AC output of the main generator 2 and an external AC power source 16 depending on whether the system is in the starter mode or in the normal running mode. The power inverter 18 converts the DC output of the power rectifier 17 into an AC output. The distributor 19 performs phase control of the power inverter 18 so as to supply to the armature winding 2*b* an armature current of a phase corresponding to the signal from the position sensor 14. The distributor 19 includes, for example, as shown in FIG. 4A and 4B, AND circuits A1~A2, NOT circuits N1~N2, differential amplifiers M1~M4, diodes d1~d3, capacitors C1~C6, resistors R1~R11, a Zener diode TZ1, and rectifiers S1. A filter 20 removes noise contained in the AC output of the power inverter 18.

A third switch 21 and a fourth switch 22 both responsive to a rotational signal from the speed detection circuit 13 perform switching of supply of a current to the field winding 9*a* of the AC exciter 9 between a DC output from a DC field controller 8A and an AC output from an AC field controller 8B depending on whether the system is in the normal running mode or the starter mode (including operation at a low speed rotation). In each of the first, second, and fourth switches 15A, 15B and 22 shown in FIGS. 3A and 3B, the character "S" designates a switching terminal of the start side, and "G" designates a switch terminal of the normal running (generating) side. In the third switch 21, "L" designates a low speed side terminal, and "H" designates a high speed side terminal.

Figures 5A, 5C:
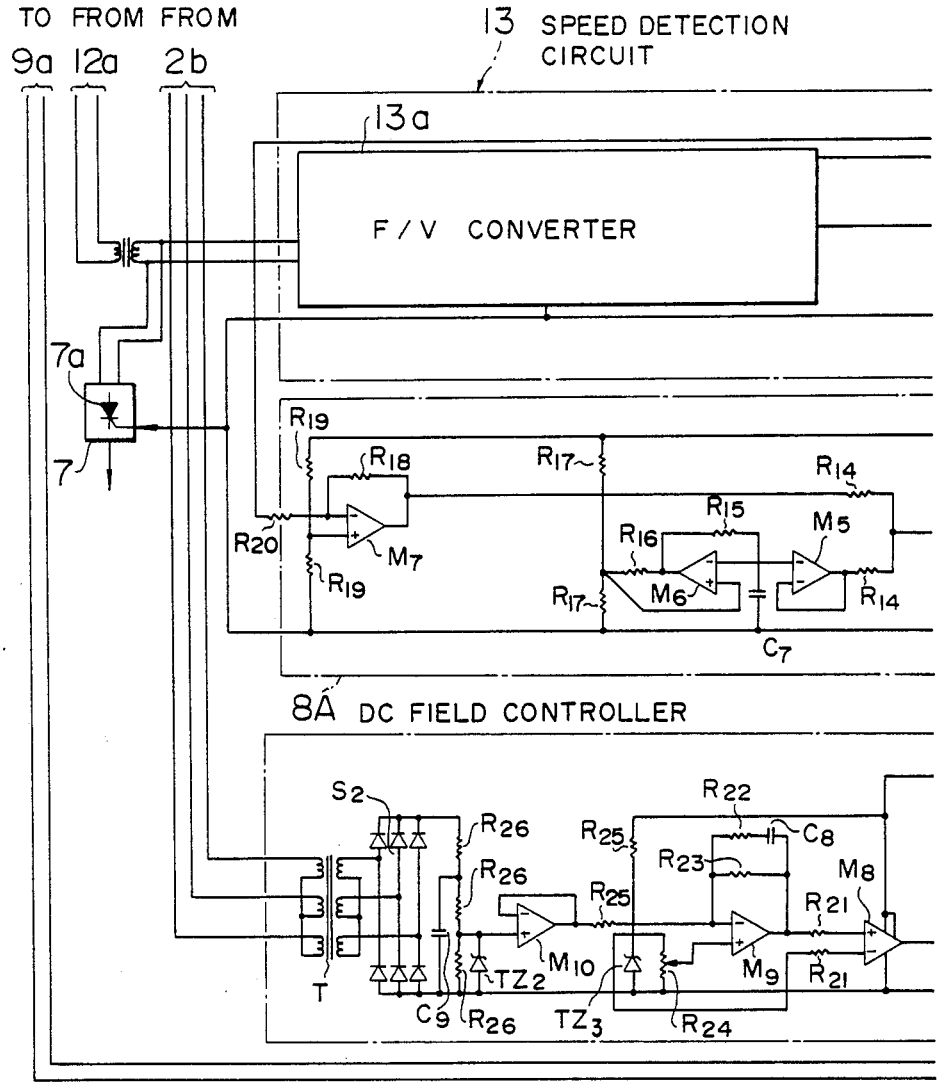
FIGS. 5A and 5B, connected as shown in FIG. 5C, comprise a circuit diagram of the DC field controller and the voltage regulator in FIG. 3.
Figure 5B:
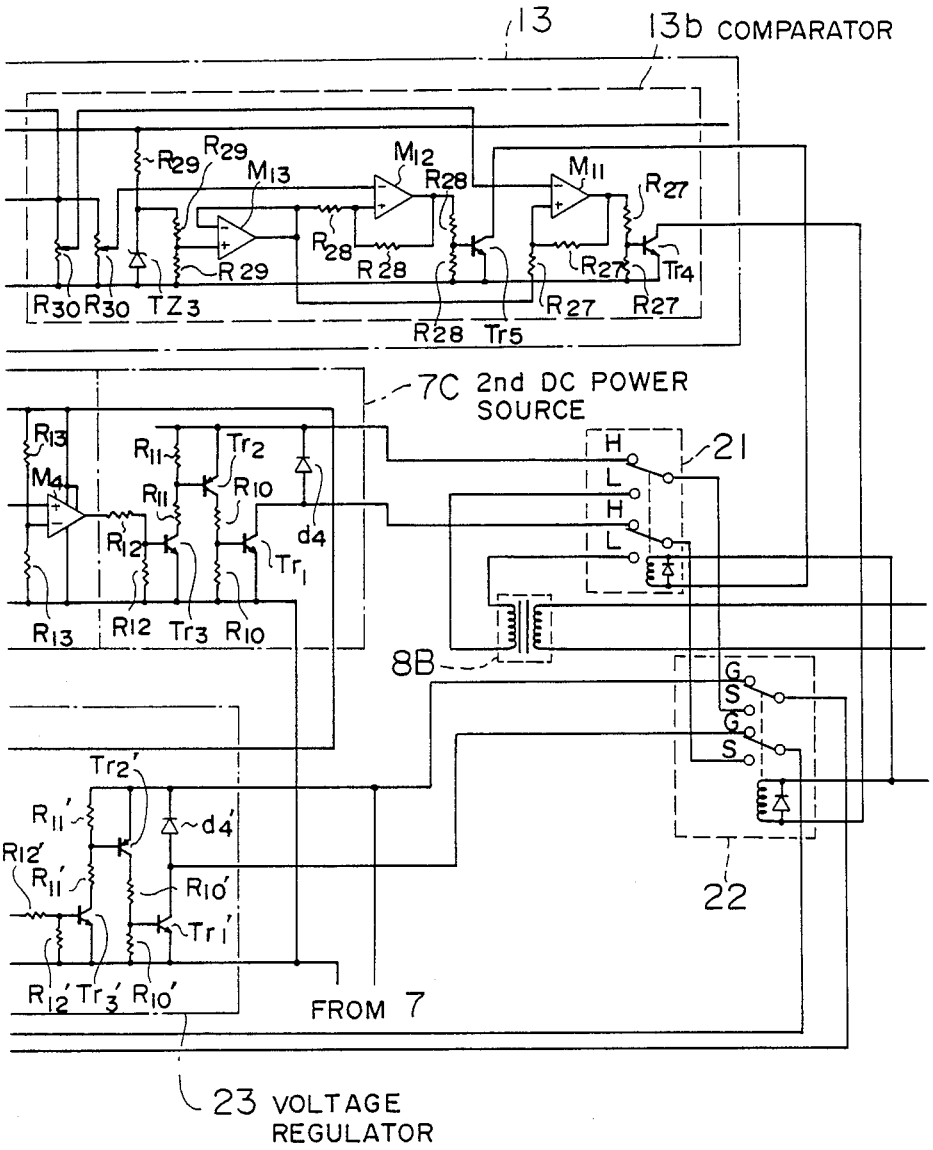

A DC power source 7 includes, for example, as shown in FIGS. 5A and 5B a full-wave rectifier 7*a* constituted by rectifier elements such as thyristors or the like which are adapted to be phase controlled, and the AC output supplied from the output winding 12*a* of the permanent magnet generator 12 is rectified to obtain a DC output. In this case, the output of the full-wave rectifier 7*a* is phase controlled based on the output of the frequency/voltage converter 13*a*.

On the other hand, a second DC power source 7C supplies DC power by rectifying AC output of an external AC power source 16, and for example, as shown in FIGS. 5A and 5B, a diode d4, transistors Tr1~Tr3, and resistors R10~R12 are included.

The DC field controller 8A includes, for example, as shown in FIGS. 5A and 5B, differential amplifiers M4~M7, resistors R13~R20, and a capacitor C7, and the DC power from the second DC power source 7C is regulated to DC power of a desired level.

Figure 2B:
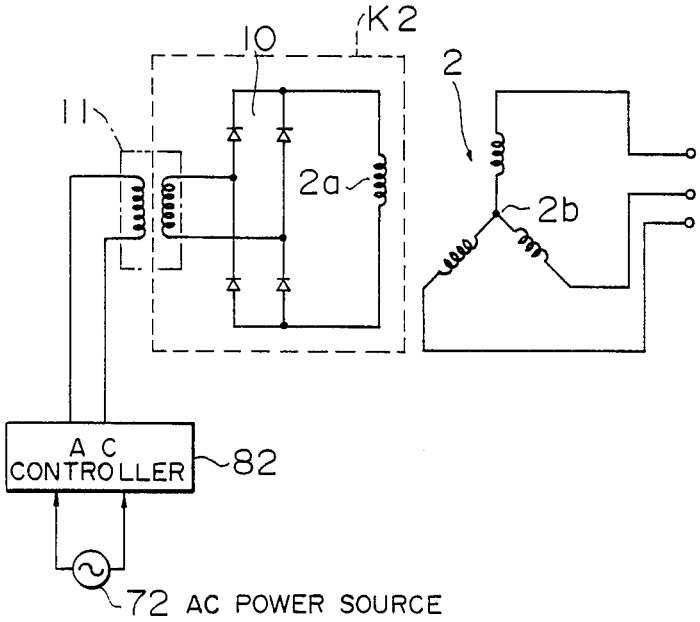
FIG. 2B PRIOR ART

The AC field controller 8B, as shown in FIGS. 3A and 3B and 5A, 5B regulates the AC power (this power corresponds to the power of the AC power source 72 in FIG. 2B) supplied from the external AC power source 16 to a desired level, and as shown in the Figures, this may include a transformer.

A voltage regulator 23 maintains the output voltage of the main generator 2 at a predetermined value regardless of the engine speed in the normal running (generator) mode, and it includes, for example, as shown in FIGS. 5A and 5B, a diode d4' transistors Tr1'~Tr3' resistors R10'~R12', differential amplifiers M8~M10, Zener diodes TZ2 ~ TZ3, resistors R21~R26, capacitors C8 ~ C9, a rectifier S2, and a transformer T.

In the embodiment described above, the rotor winding 9*b* of the AC exciter 9 is shown as having a three-phase winding, however, the winding is operable if it has not less than two phases. Also, the number of the phases of the rotary recrifier 10 may be applicable to a half wave and a full wave rectification. The switching operation of the first to fourth switches 15A, 15B, 21, and 22 are performed automatically by detecting that the output of the speed detection circuit 13 has reached a predetermined value as shown in FIGS. 3A and 3B, however, this switching may be carried out manually.

With the arrangement described above, at the time of starting the engine 1, that is, the rotor assembly K is stopped, by switching the second switch 15B to the side of the external AC power source 16, the VSCF generating system is driven as a no-commutator motor. Specifically, the AC power supplied from the external AC power source 16 is converted to DC power by the power rectifier 17, and the DC power is converted to AC power by the power inverter 18 there by to supply power to the armature winding 2*b* of the main generator 2. As a result, the main generator 2 is driven as a no-commutator motor and the engine 1 is driven and accelerated. In this case, the distributor 19 receives the position signal representative of a rotor position of the main generator 2 detected by the position sensor 14, and controls the power inverter 18 so that the commutation thereof is appropriate.

On the other hand, in such a starting time of the engine 1 and during the time in which the generated voltage of the AC exciter 9 is low due to low engine speed, this state is detected by the speed detecting circuit 13 and the speed signal is supplied to the third switch 21. As a result, the third switch 21 is switched to the side of the AC field controller 8B, and therefore to the external AC power source 16.

Accordingly, in this case, the field winding 9*a* of the AC exciter 9 is supplied with the AC power, and an AC voltage is generated in the rotor winding 9*b* due to a transformer action. On the other hand, when the rotor is rotating, the AC voltage is generated in the rotor winding 9*b* of the AC exciter 9 due to both the transformer action and the generator action. In either case, a DC current flows in the field winding 2*a* of the main generator 2, and desired field magnetic flux is generated.

When the rotational speed of the engine 1 reaches a predetermined speed during the starter mode, the third switch 21, responsive to the signal from the speed detecting circuit 13, is automatically switched to the side of the DC field controller 8A. Consequently, the field winding 9*a* of the AC exciter 9 is supplied with DC power from the second DC power source 7C through the DC field controller 8A. Thus, the field winding 2*a* of the main generator 2 is excited by the AC exciter 9 through the rotary rectifier 10, and predetermined field flux is generated. In this case, the predetermined speed for switching from AC excitation to DC excitation is at a level sufficient to produce a required field current by the AC voltage generated in the AC exciter 9 even by the DC excitation thereof.

Next, when the engine 1 is running and the engine speed reaches a normal running speed or larger, the fourth switch 22, in response to a speed signal from the speed detection circuit 13, is automatically switched to the side ("G") of the voltage regulator 23. Furthermore, the second switch 15B is switched from the external AC power source 16 to the side of the main generator 2, and the first switch 15A is disconnected from the side of the filter 20. Consequently the system is operated as the VSCF generating system. In this case, the switching operation of the first and second switches 15A and 15B is performed based on the speed signal from the speed detection circuit 13. Specifically, the main generator 2 generates AC power at a variable frequency corresponding to a variable speed of the engine 1, and after the AC power is once converted to DC power of a constant voltage by the power rectifier 17, the DC power is again converted to AC power at a low frequency. The resultant AC power is sine wave shaped including removal of noise by the filter 20, and supplied to the load as predetermined 3-phase AC power, for example, 115 V, 400 Hz. The commutation of the power inverter 18 is controlled by an oscillator 25.

The voltage regulator 23 receives the output from the armature winding 2*b* of the main generator 2 and responsive to a signal supplied through he DC power source 7 from the speed detection circuit 13 representative of a speed variation of the rotating shift 1*a* of the engine 1, regulates the voltage generated by the main generator 2 to a predetermined constant voltage by controlling the current supplied through the fourth switch 22 to the field winding 9*a* of the AC exciter 9 by setting the Zener voltage of the Zener diode TZ2 included in the voltage regulator 23 to a predetermined voltage.

In the present invention, in order to operate the VSCF generating system as an engine starting apparatus, that is, as a no-commutator motor, a power rectifier and a power inverter are used also at the time of starting the engine 1, and at the same time, an AC power source, a DC power source, and switches for supplying the power to the AC exciter are provided so as to perform the excitation by switching between AC excitation and DC excitation. According, the following advantages are provided.

(1) The starter such as an air turbine driven by a high pressure air source which has been provided separately in the prior art system becomes unnecessary. Thus, the weight is reduced, the apparatus associated with the engine is simplified, and the maintenance of the system is improved. For this purpose, the equipment which is required additionally includes merely two switches.

(2) As regard the AC exciter, since it is started by AC excitation to generate the field magnetic flux at the time of engine start, it is applicable to brushless starting. After the engine start is completed, and when the engine is running normally and in the geneator mode, by switching the excitation of the AC exciter to the DC excitation, the power required for the excitation of the AC exciter can be made minimum.

(3) Since the rotary transformer is not necessary as compared with the prior art AC excitation system, the size of the overall system can be made compact, and the weight is reduced to a great extent. Accordingly, an exciter suitable for use in airplanes can be provided.

We claim:

1. An engine start type VSCF generating system for converting a varible speed shaft output of an engine to AC power of a constant voltage at a constant frequency, comprising:

an AC exciter having a rotor winding and a field winding;

a rotary rectifier for rectifying an output of said AC exciter to a direct current:

a main generator constituted by an AC generator having a rotary field winding and an armature winding, said rotary field winding being excited by the direct current from said rotary rectifier;

said rotor winding of said AC exciter, said rotary rectifier, and said rotary field winding of said main generator being mounted on a common shaft of said engine;

a power rectifier for converting an AC output of said main generator to DC power;

a power inverter connected to said power rectifier for converting a DC output of said power rectifier to an AC power;

position sensor means mounted on the common shaft of said engine for detecting a rotational position of said rotary field winding of said main generator;

a filter connected to said power inverter for removing noise in the AC output power thereof;

switching means for connecting an input of said power rectifier to an external AC power source, and for connecting an output of said power inverter to said armature winding of said main generator by disconnecting said filter thereby to drive said main generator as a no-commutator motor at the time of starting of said engine; and a distributor connected to said position sensor means and said power inverter for controlling commutation of said power inverter based on a position detection signal from said position sensor means.

2. An engine start type VSCF generating system according to claim 1, further comprising an AC generator having a permanent magnet field mounted on said common shaft of said engine and having an output winding for supplying exciting current to said AC exciter in generator mode.

3. An engine start type VSCF generating system according to claim 2, further comprising a speed detection circuit having a frequency/voltage converter and a comparator circuit, said speed detection circuit being connected to receive an output signal from said permanent magnet type AC generator to detect a rotational speed of the rotating shaft of said engine.

4. An engine start type VSCF generating system comprising:

an AC exciter having a rotor winding and a field winding;

a rotary rectifier for rectifying an output of said AC exciter to a direct current:

a main generator constituted by an AC generator having a rotary field winding and an armature winding, said rotary field winding being excited by the direct current from said rotary rectifier;

said rotor winding of said AC exciter, said rotary rectifier, and said rotary field winding of said main generator being mounted on a common shaft of said engine;

a power rectifier for converting an AC output of said main generator to DC power;

a power inverter connected to said power rectifier for converting a DC output of said power rectifier to an AC power;

a filter connected to said power inverter for removing noise in the AC output power thereof;

an external AC power source;

an AC field controller connected to said external AC power source for regulating an AC output of said AC power source to a predetermined level;

a DC power source;

a voltage regulator connected to said DC power source for regulating a DC output of said DC power source to a predetermined level; and switch means connected to said field winding of said AC exciter, and AC field controller, and said voltage regulator, wherein said switch means is switched to connect said AC exciter to said AC field controller to excite said AC exciter by AC current from said external AC power source at the time of starting of said engine and when said engine is running at low speed, and said switch means is switched to connect said AC exciter to said voltage regulator to excite said AC exciter by DC current from said DC power source when said engine is running normally.

5. An engine start type VSCF generating system according to claim 4 futher comprising an AC generator having a permanent magnet field mounted on said common shaft of said engine and having an output winding, and a speed detection circuit connected to said output winding for detecting whether said engine is starting, running at a low speed, and running at a normal speed.

6. An engine start type VSCF generating system according to claim 5, wherein said switch means receives a speed detection signal from said speed detection circuit to automatically switch the connection to said AC exciter from said AC field controller or said voltage regulator.

* * * * *